US007246390B2

(12) United States Patent
Mitsuishi et al.

(10) Patent No.: US 7,246,390 B2
(45) Date of Patent: Jul. 24, 2007

(54) REPOSITIONING APPARATUS

(75) Inventors: Mamoru Mitsuishi, 1-2-2-905, Ojima, Koto-ku, Tokyo 136-0072 (JP); Toji Nakazawa, Tokyo (JP)

(73) Assignees: Mamoru Mitsuishi, Tokyo (JP); THK Co., Ltd., Tokyo (JP)

( * ) Notice: Subject to any disclaimer, the term of this patent is extended or adjusted under 35 U.S.C. 154(b) by 0 days.

(21) Appl. No.: 10/431,639

(22) Filed: May 8, 2003

(65) Prior Publication Data

US 2004/0003468 A1 Jan. 8, 2004

(30) Foreign Application Priority Data

May 8, 2002 (JP) ..... 2002-132222

(51) Int. Cl.
*A47B 71/00* (2006.01)

(52) U.S. Cl. ..... 5/648; 5/621; 5/624

(58) Field of Classification Search ..... 5/648, 5/630, 624, 621

See application file for complete search history.

(56) References Cited

U.S. PATENT DOCUMENTS 4,509,509 A 4/1985 Bouvet et al. ..... 128/24.1
5,423,862 A 6/1995 Clarke et al. ..... 606/242
5,645,079 A * 7/1997 Zahiri et al. ..... 5/610
6,286,164 B1 * 9/2001 Lamb et al. ..... 5/600
6,371,897 B1 4/2002 Huang ..... 482/148

FOREIGN PATENT DOCUMENTS

DE 125351 11/1901
EP 0496528 A1 7/1992
JP 11056888 3/1999

OTHER PUBLICATIONS

Office action and translation dated Aug. 28, 2003 from the corresponding European application.

* cited by examiner

*Primary Examiner*—Patricia Engle
*Assistant Examiner*—Fredrick Conley
(74) *Attorney, Agent, or Firm*—Westerman, Hattori, Daniels & Adrian, LLP.

(57) ABSTRACT

The repositioning apparatus of the invention includes a supporting bed for supporting at least a lower body of a patient, who needs repositioning therapy on his/her leg, a lower leg supporting bed for supporting a lower leg of the patient, a first movable table for allowing the lower leg supporting bed to move about a substantially horizontal axis, a first drive unit for driving the first movable table, a second movable table for moving the lower leg supporting bed in the substantially horizontal direction, and a second drive unit for driving the second movable table. Accordingly, the repositioning apparatus can make the lower leg of the patient perform a twisting action and a bending and stretching action, which are inevitable action for repositioning the patient's lower leg.

1 Claim, 8 Drawing Sheets

REPOSITIONING APPARATUS

BACKGROUND OF THE INVENTION

The present invention relates to a repositioning apparatus and, more specifically, a repositioning apparatus suitable for giving a lower leg of a patient repositioning therapy.

In the case where a bone is fractured or dislocated, repositioning therapy is performed for the purpose of remedy. In the relate art, when performing repositioning therapy, a person who gives repositioning therapy, such as a doctor or a practitioner, makes, by his own force, the patient's lower leg perform various actions such as bending, stretching, or twisting.

However, when making the patient's lower leg perform various actions, a significant human power is necessary, which forces the doctor or the practitioner to do heavy work, and thus the number of patients that the doctor or the practitioner can give therapy in a day is small.

In order to solve such a problem, a joint physical therapy instrument is proposed in JP-A-11-56888. As shown in FIG. 8, a joint physical therapy instrument 1 includes a top plate 2 on which a patient a lies, a femoral region holding unit 3 for supporting a femoral region b of the patient a in a state of inclining upward, a traction unit 4 for holding an ankle of the patient a and pulling a lower leg c in the longitudinal direction, and a rolling unit 5 for holding a head portion of tibia d and rolling in the vertical direction with respect to the longitudinal axis of the lower leg c.

The joint physical therapy instrument 1 can expand and contract a knee of the patient a by operating the traction unit 4 and, simultaneously, can shake the knee laterally by operating the rolling unit 5.

However, the joint physical therapy instrument 1 in the related art can only make the patient's lower leg to perform bending, stretching, and shaking in the lateral direction, and thus cannot contribute to repositioning therapy. When performing repositioning therapy, the patient's lower leg is forced to perform a twisting action in addition to a bending and stretching action. Other actions, such as moving the lower leg in the upward, downward, right, and left directions or moving the ankle in various ways, are also required in many cases, and these actions must still be performed by the human power of a plurality of persons, including the doctor or the practitioner and his/her assistants.

SUMMARY OF THE INVENTION

Accordingly, it is an object of the present invention to provide a repositioning apparatus that can make a lower leg of a patient perform actions required for the purpose of repositioning.

The present invention is a repositioning apparatus, and is constructed as described below in order to solve the technical problems described above.

The repositioning apparatus of the invention includes a supporting bed for supporting at least a lower body of a patient who needs repositioning therapy on his/her leg, a lower leg supporting bed for supporting a lower leg of the patient, a first movable table for allowing the lower leg supporting bed to move about a substantially horizontal axis, a first drive unit for driving the first movable table, a second movable table for moving the lower leg supporting bed in the substantially horizontal direction, and a second drive unit for driving the second movable table.

According to the invention, the repositioning apparatus can make the lower leg of the patient perform a twisting action (in the direction indicated by an arrow R) and a bending and stretching action (in the direction indicated by an arrow Y), which are inevitable action for repositioning the patient's slower leg.

The repositioning apparatus according to the invention may further includes a swinging arm for swinging the lower leg supporting bed in a substantially horizontal plane, a third movable table for moving the lower leg supporting bed in the substantially vertical direction, and a third drive unit for driving the third movable table.

In this case, the apparatus can make the patient's lower leg perform not only the twisting action (in the direction indicated by the arrow R) and the bending and stretching action (in the direction indicated by the arrow Y), but also a laterally moving action (in the direction indicated by an arrow X) and a vertically moving action (in the direction indicated by an arrow Z). Consequently, the repositioning apparatus of the invention can make the patient's lower leg perform almost all the actions that is required for repositioning the lower leg.

In addition, the repositioning apparatus of the invention may include an arm drive unit, not shown, for driving the swinging arm.

The swinging arm may be swung by a human power, but it can be performed automatically according to the invention.

The swinging arm may be telescopic.

In this arrangement, the repositioning apparatus of the invention can cope with patients of any physical constitutions, such as small, large, adult, child, and so on, by telescopically adjusting the swinging arm.

It is also possible to provide an arm expansion device for telescopically adjusting the swinging arm.

Expanding and contracting the swinging arm can be made by a human power, but in this case, such actions can be made automatically, and thus almost no human power is necessary according to the invention.

Furthermore, the swinging arm can make the leg perform the laterally moving action (in the direction indicated by the arrow X), the first movable table can make the leg perform the twisting action (in the direction indicated by the arrow R), the second movable table can make the leg perform the bending and stretching action (in the direction indicated by the arrow Y), and the third movable table can make the leg perform the vertically moving action (in the direction indicated by the arrow Z).

In this arrangement, the repositioning apparatus according to the invention is suitable for the doctor to perform repositioning therapy as desired.

In addition, the swinging arm, the first movable table, the second movable table, the third movable table and the lower leg supporting bed can be assembled to the supporting bed in predetermined sequence, for example, of the swinging arm, the third movable table, the second movable table, the first movable table, and the lower leg supporting bed in stages, as described.

In this arrangement, the construction can be simplified in comparison with the case in which the each part, such as the swinging arm, is independently and separately attached. The sequence of assembling the swinging arm and so on is not limited thereto, and may be changed as needed. Even when the sequence of assembly is changed, the effects, which is proportional to the simplification, are achieved.

The lower leg supporting bed may include a fixing device for fixing the lower leg of the patient.

For example, a band is employed as the fixing device. In this case, a force is effectively transmitted to the patient's lower leg from the lower leg supporting bed.

A joint member, which can move freely about the substantially horizontal axis, and a fourth drive unit for moving the joint member about the substantially horizontal axis can be interposed between the lower leg supporting bed and the first movable table.

In this case, the repositioning apparatus of the invention can make an ankle perform a bending movement (in the direction indicated by an arrow Q) in the fore-and-aft direction.

The repositioning apparatus of the invention may includes a second joint member that constitutes a universal joint with the joint member and is able to move freely about the substantially vertical axis, and a fifth drive unit for moving the second joint member about the substantially vertical axis may be interposed between the lower leg supporting bed and the first movable table.

In this arrangement, the repositioning apparatus of the invention can make the ankle perform a lateral swinging action (in the direction indicated by an arrow P).

The lower leg supporting bed may include an auxiliary member, which is capable of expanding and contracting longitudinally of the lower leg and is, simultaneously, detachable.

In this arrangement, in the normal state, the burden of the patient can be alleviated by attaching the auxiliary member to the lower leg supporting bed and supporting the entire lower leg in the expanded state.

When having an X-ray taken, the auxiliary member can be contracted or removed to prevent the auxiliary member from being X-rayed.

The lower leg supporting bed may include a sole pad member for placing a sole of the patient.

In this arrangement, when making the leg perform bending and stretching action in the fore-and-aft direction, or when making the ankle perform a bending action in the fore-and-aft direction or laterally moving action, a force is applied to the entire region of the sole of the patient, whereby the patient is prevented from being applied with needless pain.

The components described above may be combined with each other as long as possible.

DETAILED DESCRIPTION OF THE PREFERRED EMBODIMENT

Figure 1:
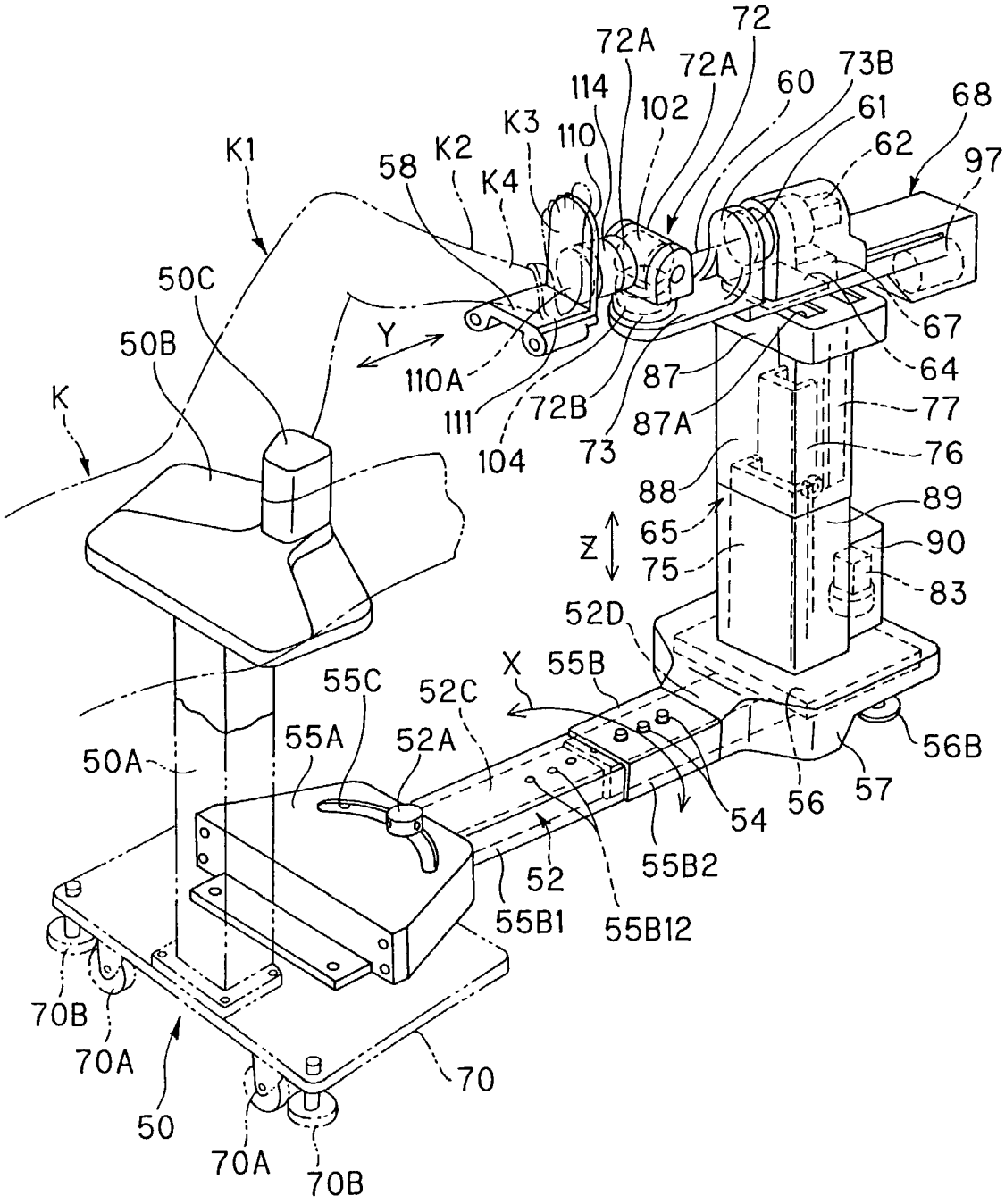
FIG. 1 is a perspective view showing a repositioning apparatus according to the present invention.
Figure 2:
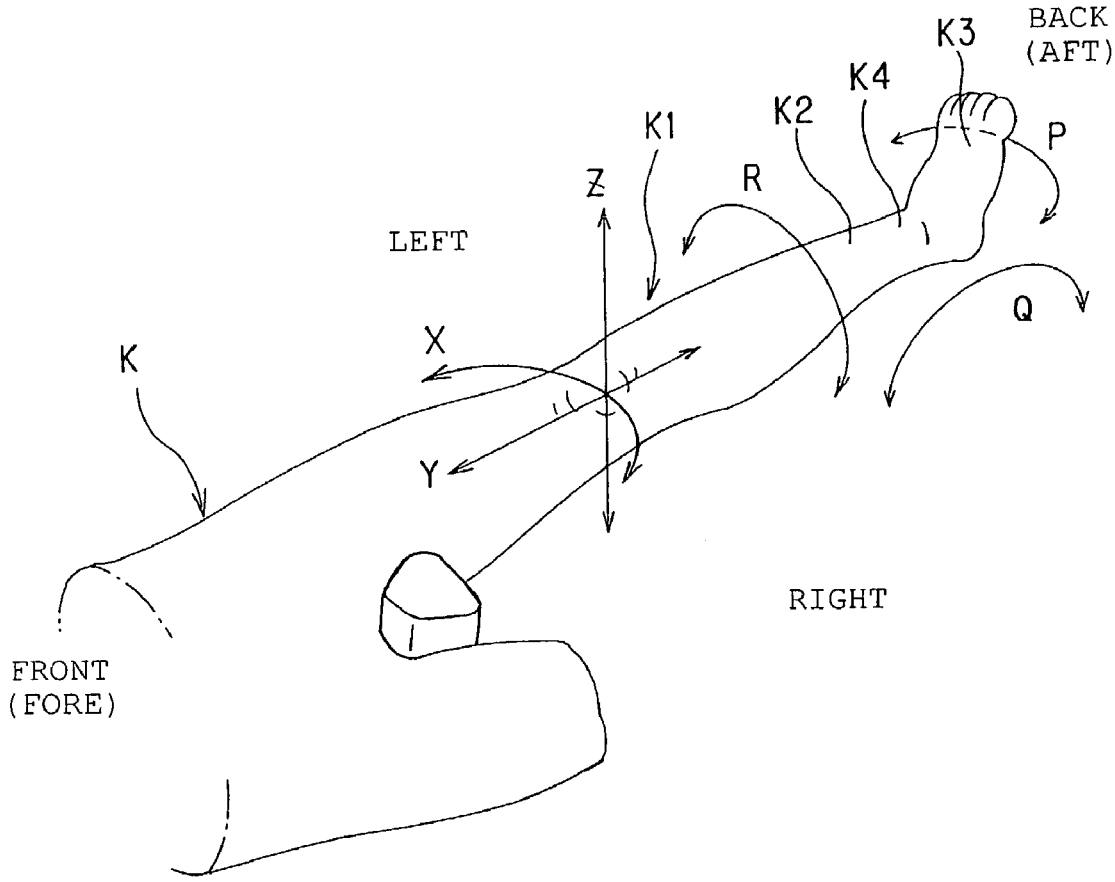
FIG. 2 is an explanatory drawing showing an action that the repositioning apparatus shown in FIG. 1 can make a leg of a patient perform.

FIG. 1 is a perspective view showing an entire repositioning apparatus 5 according to the invention. The repositioning apparatus 5 is used for giving a leg K1 of a patient K repositioning therapy, and includes a supporting bed 50 for supporting at least a lower body of the patient K who needs positioning therapy on his/her leg K1. The patient K is also shown in FIG. 2.

The supporting bed 50 includes a linearly formed swinging arm 52 attached so as to be capable of a swinging motion in a substantially horizontal plane. More specifically, amounting plate 53, shown in FIG. 3, is attached to the supporting bed 50 by a bolt, and the swinging arm 52 is swingably attached at the proximal end thereof to the mounting plate 53 via a supporting pin 53A.

Figure 7:
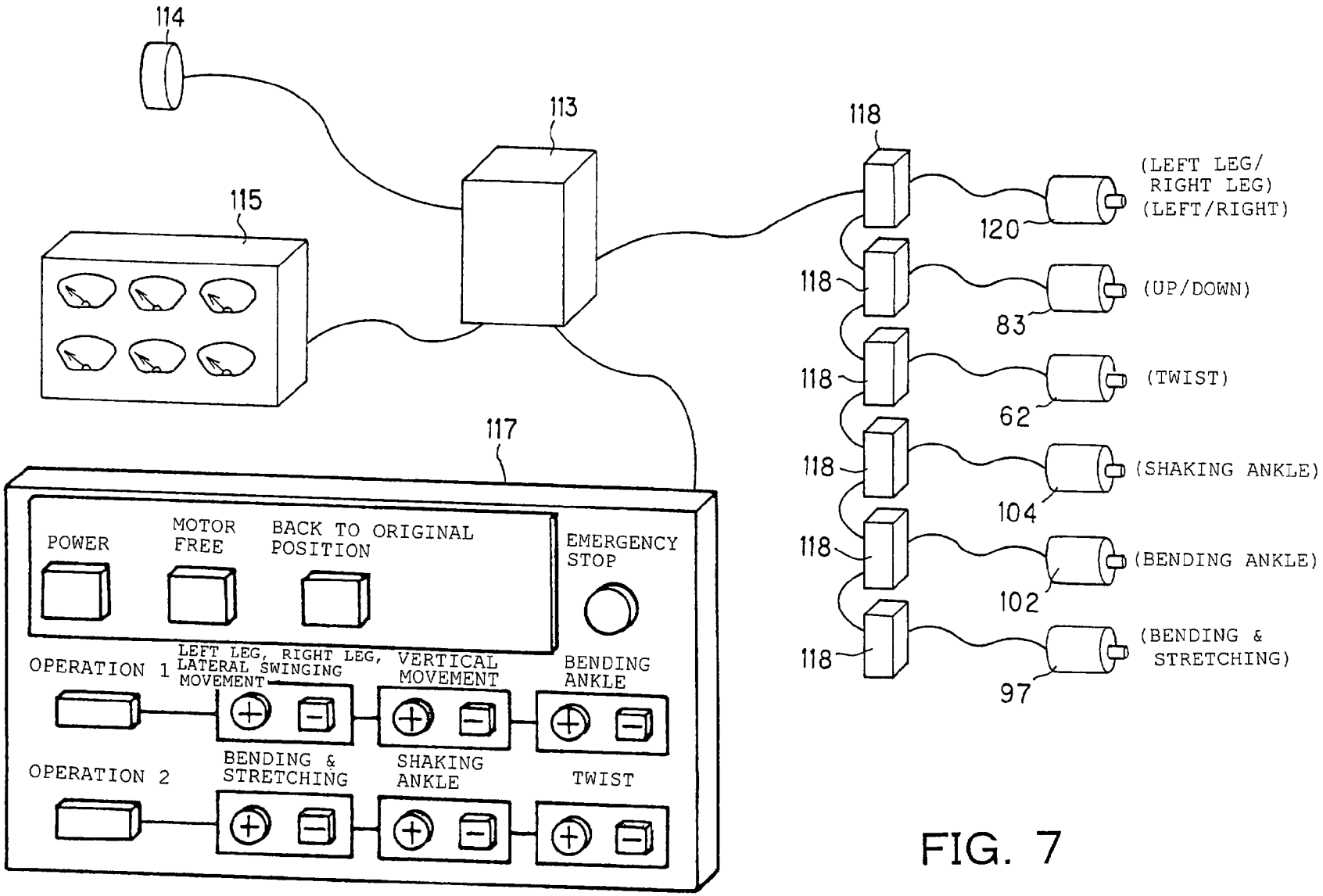
FIG. 7 is a drawing showing a control system of the repositioning apparatus shown in FIG. 1.
Figure 8:
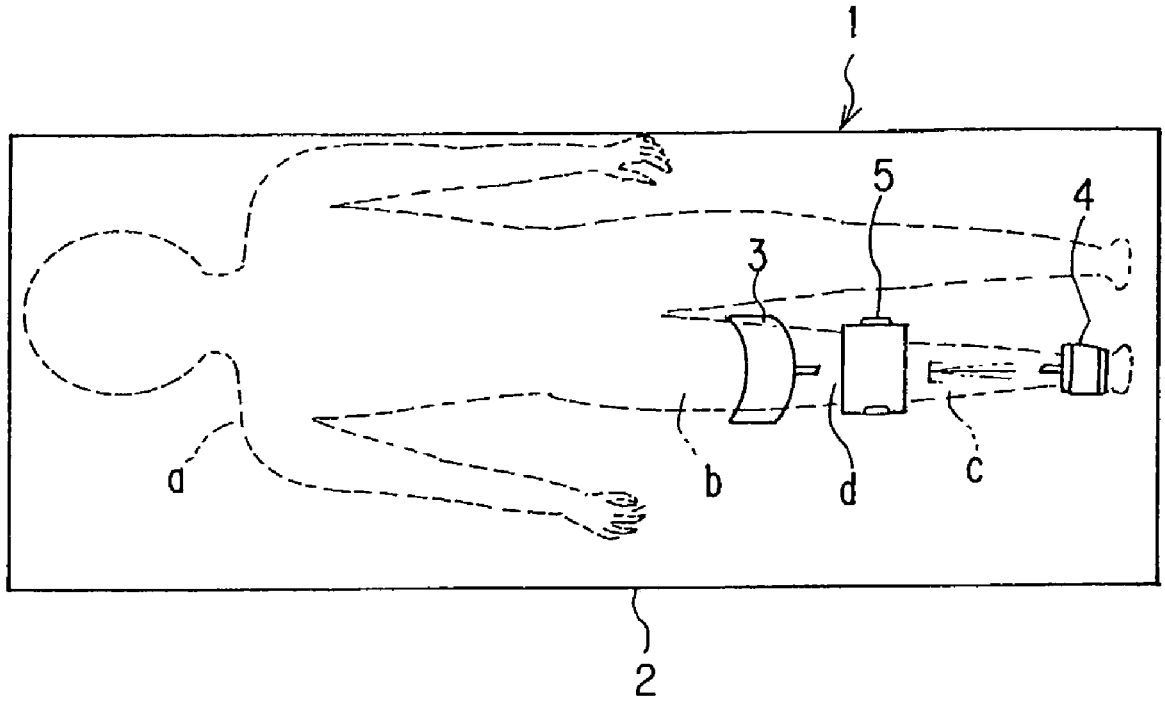
FIG. 8 is a drawing showing a joint physical therapy instrument according to the related art.

A positioning bolt 52A is screwed into the swinging arm 52 in the vicinity of the proximal end thereof and the neck of the bolt 52A is inserted through an arcuate guiding groove 53B formed on the mounting plate 53. In other words, the swinging arm 52 is moved to a desired position in a state in which the positioning bolt 52A is loosened, and when positioning is completed, the positioning bolt 52A is tightened again. The swinging arm 52 is driven or swung by a manual operation of a doctor or a practitioner, or by an arm drive unit, not shown (only a motor included as a driving source is shown in FIG. 7 as a reference number 120). When swinging the swinging arm 52 automatically by the arm drive unit, the positioning bolt 52A described above is preferably replaced with an electromagnetic chuck (not shown) or the like to automate positioning and cancellation of positioning.

As shown in FIG. 1, covers 55A and 55B for covering the mounting plate 53 and the swinging arm 52 are provided, and the cover 55A is formed with an arcuate hole 55C for avoiding interference with the positioning bolt 52A.

Figure 3:
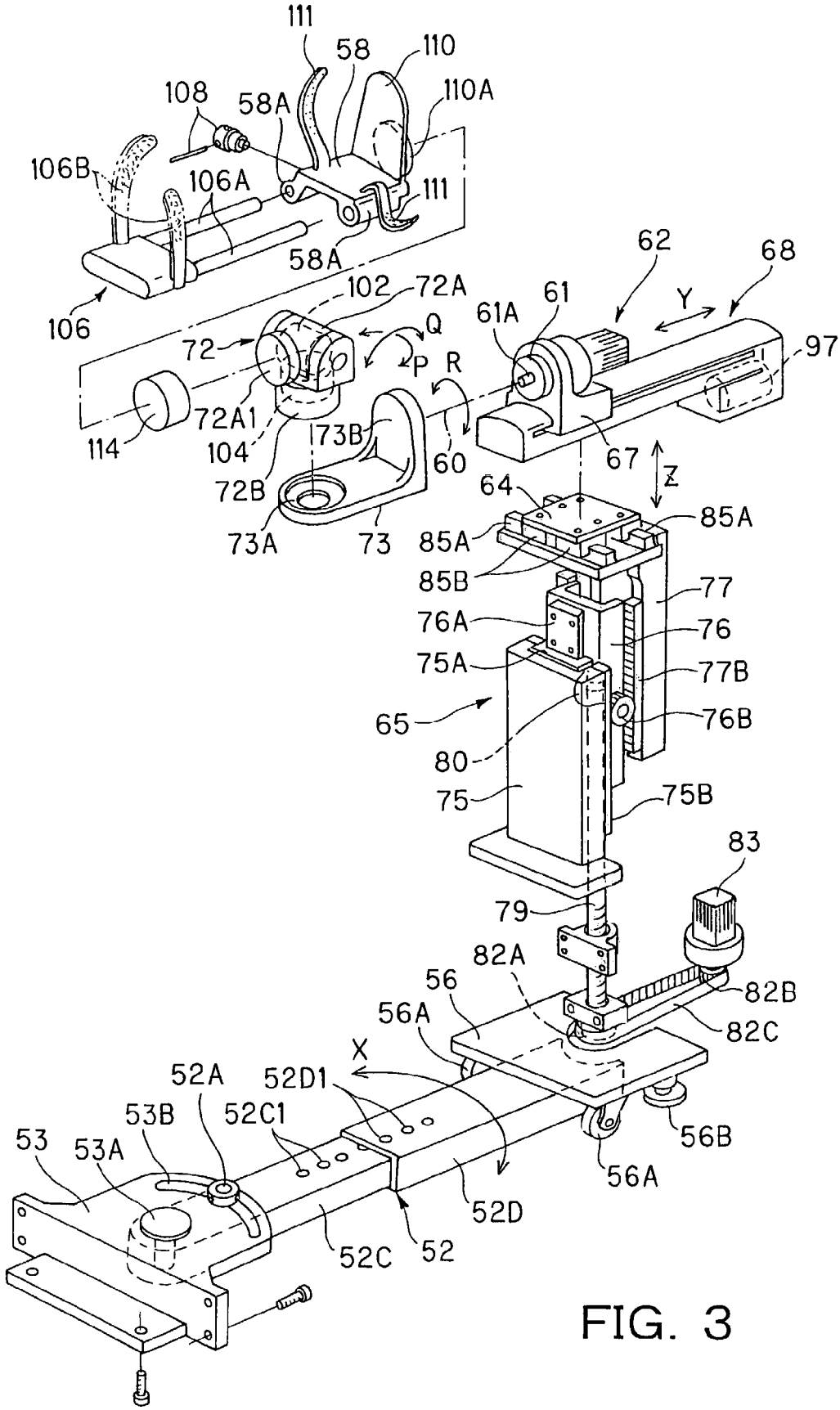
FIG. 3 is an exploded perspective view of the repositioning apparatus shown in FIG. 1.

As shown in FIG. 1 and FIG. 3, a supporting plate 56 is secured to the free end of the swinging arm 52. The supporting plate 56 includes a caster 56A for facilitating the swinging motion of the swinging arm 52 on the floor, and a stopper 56B for stopping and fixing the swinging arm 52 at a desired position. The supporting plate 56 is covered with a cover 57 shown in FIG. 1.

When swinging the swinging arm 52 automatically by the arm drive unit, the stopper 56B is replaced by a member that can fix the swinging arm 52, or cancel the fixation of the swinging arm 52 automatically, in association with replacement of the positioning bolt 52A by the electromagnetic chuck (not shown).

A lower leg supporting bed 58 for supporting the lower leg K2 of the patient K is disposed immediately above the swinging arm 52. The swinging arm 52 is used for swinging the lower leg supporting bed 58 in a substantially horizontal plane.

As shown in FIG. 1 and FIG. 3, the repositioning apparatus 5 includes a first movable table 61 for moving or turning the lower leg supporting bed 58 about a substantially horizontal axis 60, and a motor 62 as a first drive unit for rotating the first movable table 61. The repositioning apparatus 5 also includes a third movable table 64 for moving the lower leg supporting bed 58 in the substantially vertical direction, a third drive unit 65 for driving the third movable table 64, a second movable table 67 for moving the lower supporting bed 58 in the substantially horizontal direction, and a second drive unit 68 for driving the second movable table 67.

The swinging arm 52, the first movable table 61, the second movable table 67, the third movable table 64 and the lower leg supporting bed 58 are mounted to the supporting bed 50 in stages in a predetermined sequence. In the present embodiment, they are mounted in order of the swinging arm 52, the third movable table 64, the second movable table 67, the first movable table 61, and the lower leg supporting bed 58 in stages, and the lower leg supporting bed 58 is mounted to the first movable table 61, which is the last stage.

The order of mounting of the swinging arm 52 and the movable tables 61, 67, and 64 is not limited to the present embodiment, and may be varied as needed.

The swinging arm 52 is used for making the leg K1 of the patient K shown in FIG. 1 and FIG. 2 perform a lateral (in the direction of an arrow X) movement, that is, a swinging movement, or positioning the lower leg supporting bed 58 at the position corresponding to either one of the left leg or the right leg of the patient K. The first movable table 61 is used for making the leg K1 of the patient K perform a twisting action (in the direction indicated by an arrow R), the second movable table 67 is used for making the leg K1 perform a movement in the fore-and-aft direction (in the direction indicated by an arrow Y), that is, a bending and stretching action, and the third movable table 64 is used for making the leg K1 perform the vertical (in the direction indicated by an arrow Z) movement.

Subsequently, the components described above will be described.

The supporting bed 50 for supporting at least the lower body of the patient K will now be described.

As shown in FIG. 1, the supporting bed 50 includes a base 70 as a base portion of the apparatus, a post 50A fixed at the lower end onto the base 70, and a hip rest 50B mounted on the upper end of the post 50A for placing the hip of the patient K. The hip rest 50B is provided with a column support 50C for placing between the patient K's legs for preventing the patient K from moving during repositioning therapy.

The base 70 includes a caster 70A for transporting the repositioning apparatus and as topper 70B for stopping and fixing the apparatus transported to a desired position.

Subsequently, the first movable table 61 and the motor (the first drive unit) 62 for moving the lower leg supporting bed 58 about the substantially horizontal axis 60, that is, for making the leg K1 of the patient perform the twisting action (in the direction indicated by the arrow R), and the construction therearound will be described.

As shown in FIG. 1 and FIG. 3, the first movable table 61 is formed into a disk shape, and mounted on an output shaft (that will be described later) of the motor 62. The lower leg supporting bed 58 is connected to the first movable table 61 sequentially via an universal joint 72 and a link-up plate 73.

The universal joint 72 interposed between the lower leg supporting bed 58 and the first movable table 61 includes a joint member 72A movable, that is, rotatable, about the substantially horizontal axis, and a second joint member 72B, which constitutes the universal joint 72 together with the joint member 72A, movable, that is, rotatably, about the substantially vertical axis.

A round seat 73A is formed at the front end of the link-up plate 73, and the lower end of the second joint member 72B is fitted to the seat 73A. The rear end 73B of the link-up plate 73 is fitted to the first movable table 61.

Subsequently, the third movable table 64 and the third drive unit 65 for making the lower leg supporting bed 58 move in the substantially vertical direction, that is, for making the leg K1 of the patient perform a vertically moving action (in the direction indicated by the arrow Z), and the construction therearound will be described.

As shown in FIG. 1, a guide member 75 is projecting upright from the supporting plate 56 mounted to the free end of the swinging arm 52. The third movable table 64 is attached to the guide member 75 so as to be movable in the vertical direction (in the direction indicated by the arrow Z).

More specifically, as shown in FIG. 3, an intermediate member 76 is attached to the guide member 75 so as to be capable of moving in the vertical direction, and an elevating member 77 is attached to the intermediate member 76 so as to be capable of moving in the vertical direction. The third movable table 64 is mounted on the upper end of the elevating member 77.

More specifically, a track rail 76A is fixed to one side of the intermediate member 76, and the track rail 76A is guided by a block 75A fixed on the side of the guide member 75, whereby the intermediate member 76 is guided in the vertical direction.

Though it is not shown in the drawing, a similar track rail and a block are fixed on the other side surface of the intermediate member 76 and on the side of the elevating member 77 opposing thereto, so that the elevating member 77 is guided in the vertical direction.

As shown in FIG. 3, racks 75B and 77B are provided on the opposing surfaces of the guide member 75 and the elevating member 77, respectively. A pinion 76B provided on the intermediate member 76 engages these racks 75B and 77B. Accordingly, so called a double-speed mechanism is constructed.

A ball screw shaft 79 is provided upright on the supporting plate 56, and rotatably supported thereby. On the other hand, the intermediate member 76 is provided with a ball screw nut 80 integrated therein and the ball screw shaft 79 is screwed into the ball screw nut 80. A large diameter toothed belt pulley 82A is fitted on the lower end of the ball screw shaft 79.

A motor 83 is disposed in the vicinity of the toothed belt pulley 82A and a small diameter toothed belt pulley 82B is fitted on the output shaft of the motor 83. Then a toothed belt 82C is wound around both of the toothed belt pulleys 82A and 82B.

The third drive unit 65 is constructed as described above. In the construction described above, when the ball screw shaft 79 is rotated by the operation of the motor 83, and the ball screw nut 80 screwed on the ball screw shaft 79 is moved upward and downward, and then the intermediate member 76 integrally connected to the ball screw nut 80 is moved in the vertical direction.

Then, the pinion 76B provided on the intermediate member 76 rotates around the rack 75B of the guide member 75 in the engaged state, and the elevating member 77 having the rack 77B in engagement with the pinion 76B moved upward and downward. Consequently, the third movable table 64 moved in the vertical direction and thus movement of the lower leg supporting bed 58 is achieved.

The third movable table 64, and hence the lower leg supporting bed 58, are movable laterally (in the direction indicated by the arrow X) of the elevating member 77. In other words, as shown in FIG. 3, a track rail 85A is attached to the upper end of the elevating member 77 so as to extend in the lateral direction. A movable block 85B is fixed to the lower surface of the third movable table 64, and the movable block 85B movably engages the track rail 85A.

As shown in FIG. 1, the cover 87 to 90 for covering the third movable table 64 and the second drive unit 68 are provided. However, the cover 87 for covering the third movable table 64 is formed with an opening 87A for enabling a reciprocal movement of the movable block 85B. The cover 88 for covering mainly the elevating member 77 is movable vertically of the cover 89 for covering the guide member 75 on the fixed side.

Subsequently, the second movable table 67 and the second drive unit 68 for moving the lower leg supporting bed 58 in the substantially horizontally, that is, for making the leg K1 of the patient perform a movement in the fore-and-aft direction (in the direction of the arrow Y), a bending and stretching action, and the construction therearound will be described.

Figure 4:
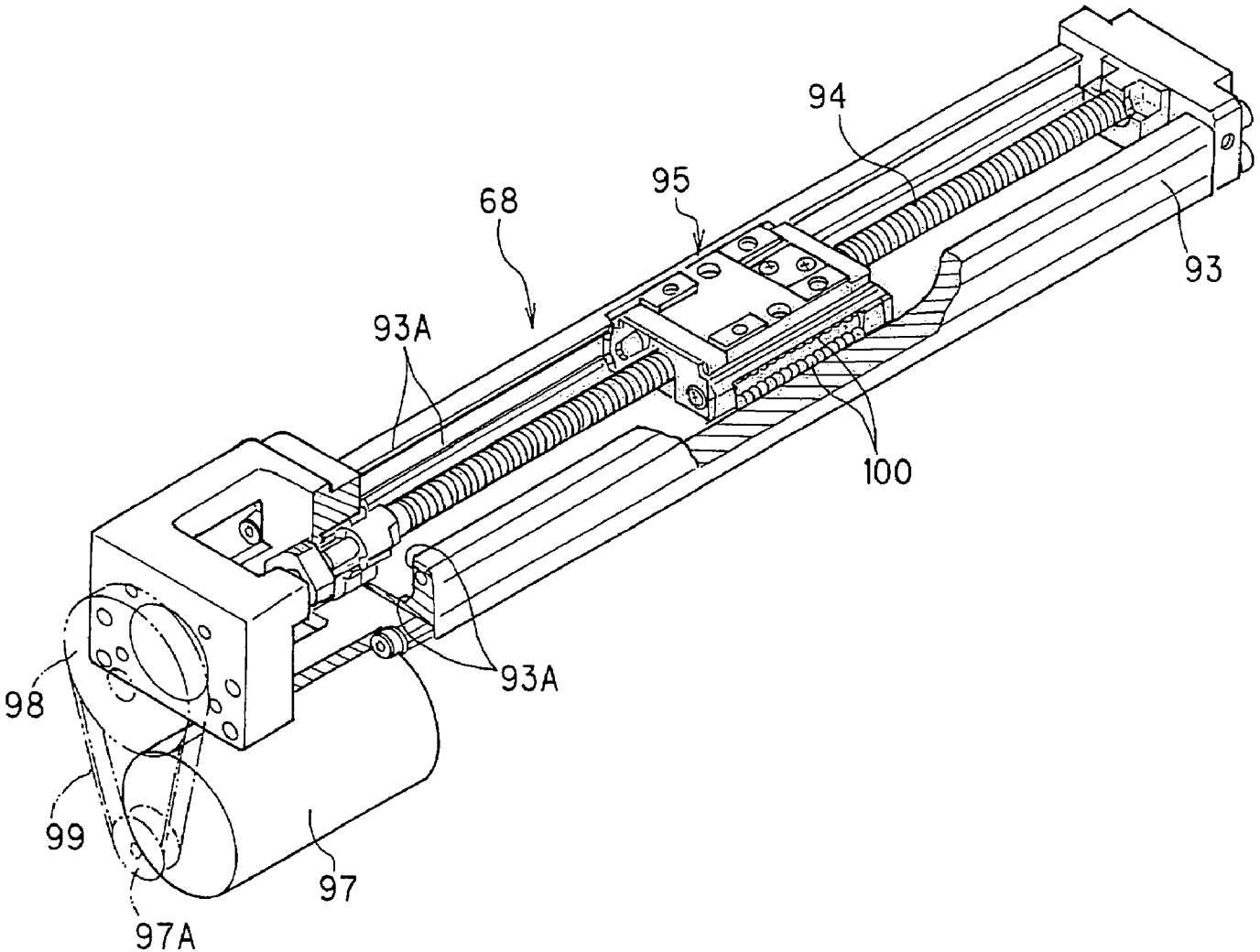
FIG. 4 is a perspective view, partly in cross section, of a third drive unit included in the repositioning apparatus shown in FIG. 1.

The second drive unit 68 includes a linear drive unit shown in FIG. 4. FIG. 4 shows an internal structure with a cover of the second drive unit 68 removed. As shown in the drawing, the second driving means 68 includes an outer rail 93 of high rigidity having a U-shape in cross section, a ball screw shaft 94 disposed in the hollow portion in the outer rail 93 and rotatably attached to the outer rail 93 at both ends via bearings, and an inner block 95 including a ball screw nut (not shown), which is screwed on the ball screw shaft 94. The second movable table 67 is secured on the upper surface of the inner block 95 with a bolt.

A motor 97 (shown also in FIG. 1 and FIG. 3) is provided at one end of the outer rail 93. A small diameter toothed belt pulley 97A is fitted on the output shaft of the motor 97. A large diameter toothed belt pulley 98 is connected to one end of the ball screw shaft 94 via a coupler, and a toothed belt 99 is wound around the both of the toothed belt pulleys 97A and 98.

The outer rail 93 is formed with ball rolling grooves 93A on the inner sides, for example, two grooves each, along the entire length thereof. The inner block 95 is provided with caterpillar circulating paths including load ball rolling grooves corresponding to these ball rolling grooves 93A, and a number of balls 100 is arranged and stored in each caterpillar circulating paths.

The second drive unit 68 is constructed as described above. In this arrangement, the ball screw shaft 94 is rotated by the operation of the motor 97, and the inner block 95 including the ball screw nut, which is screwed onto the ball screw shaft 94, is moved and hence the third movable table 67 secured to the inner block 95 is moved. Therefore, the lower leg supporting bed 58 is moved in the substantially horizontal direction.

Though the main construction of the repositioning apparatus is as described above, a construction as will be described later is added.

The joint member 72A of the universal joint 72 shown in FIG. 1 and FIG. 3 (movable or rotatable about the substantially horizontal axis) includes a hollow motor 102 integrated therein as a fourth drive unit for making the joint member 72A rotate about its axis of rotation. The second joint member 72B (movable or rotatable about the substantially vertical axis) that constitutes the universal joint 72 together with the joint member 72A includes a hollow motor 104 integrated therein as a fifth drive unit for making the second joint member 72B rotate about its axis of rotation.

In this arrangement, the lower leg supporting bed 58 is moved in the direction indicated by an arrow Q by operating the hollow motor 102. In other words, the apparatus can make the ankle K4 of the patient perform a bending action in the fore-and-aft direction. When another hollow motor 104 is operated, the lower leg supporting bed 58 is moved in the direction indicated by an arrow P, whereby the apparatus can make the ankle K4 of the patient perform a lateral swinging action.

As is clear from FIG. 1 and FIG. 3, the lower leg supporting bed 58 is formed into a table having a suitable dimensions for receiving and holding a foot K3 and the lower side of the lower leg K2 of the patient K.

The lower leg supporting bed 58 is, as shown in FIG. 3, attached as needed with an auxiliary table 106, that is, an auxiliary member, which is capable of expanding and contracting longitudinally of the lower leg K2 and is, simultaneously, detachable. The auxiliary table 106 has a pair of rods 106A, and the auxiliary table is capable of expanding and contracting, and is detachable by inserting the rods 106A into a sleeve 58A formed on the lower leg supporting bed 58.

As shown in FIG. 3, a screw member 108 includes a handle, which is screwed into the sleeve 58A from the side surface thereof, for locking the rod 106A, a sole pad member 110 (for placing the sole of the patient K) is provided at the end of the lower leg supporting bed 58, and a band 111 is provided as a fixing device for fixing the lower leg K2 of the patient K. A band 106B, as the fixing device for fixing the lower leg (K2) of the patient K, or the leg K1 in this case, is also provided on the auxiliary table 106.

The swinging arm 52 is telescopic. More specifically, as shown in FIG. 1 and FIG. 3, the swinging arm 52 includes a first arm 52C on the proximal side, and a second arm 52D on the free end side. The first and second arms 52C and 52D are adapted to guide each other in the longitudinal direction. As is clear from FIG. 1, the cover 55B for covering the swinging arm 52 also includes a first cover 55B1 and a second cover 55B2, which are connected so as to guide each other in the longitudinal direction.

The second arm 52D and the second cover 55B2 are formed with bolt insertion holes 52D1 (the bolt insertion holes formed on the second cover 55B2 are not designated by a reference numeral) at the positions corresponding to each other in the longitudinal direction and at regular intervals, and a bolt 54 is inserted thereto. The first arm 52C and the second cover 55B1 are formed with screw holes 52C1 and 55B12 at the positions corresponding to the respective bolt insertion holes, so that the bolts 54 can be screwed into these screw holes 52C1 and 55B12.

In other words, the swinging arm 52 is telescopically adjusted by loosening the bolts 54 to release the engaged state between the screw holes 52C1 and 55B12, moving the second arm 52D and the second cover 55B2 with respect to the first arm 52C and the first cover 55B1 to adjust the relative positions of the swinging arm 52 and the cover 55B to obtain a desired length, and screwing again the bolts 54 into the screw holes 55C1 and 55B12 in this state.

The telescopic adjustment of the swinging arm 52 is not limited to a manual system as described above, and maybe automated. Although it is not shown in the drawing in detail, for example, it is realized simply by providing an arm expansion device including a ball screw mechanism and a driving mechanism, such as a motor, for operating the ball screw mechanism as shown in FIG. 4.

The repositioning apparatus 5 is provides with a device for limiting power transmission so as to prevent the leg K1 of the patient K from receiving an unreasonable force from the apparatus. This device has a completely mechanical structure, and the inventor refers this to as a mechanical safety switch. The construction of the mechanical safety switch will be described below.

In the repositioning apparatus, the mechanical safety switch includes a drive unit for making the leg K1 of the patient K perform the twisting action (in the direction indicated by an arrow R) and a drive unit for making the same perform the bending and stretching action (in the direction indicated by the arrow Y). It is also applicable to provide the mechanical safety switch as needed on the drive unit for making the patient perform other actions, such as the laterally moving action (in the direction indicated by the arrow X) and the vertically moving action (in the direction indicated by the arrow Z) of the leg K1, the bending action in the fore-and-aft direction (in the direction indicated by the arrow Q) and the lateral swinging action (in the direction indicated by the arrow P) of the ankle K4, as a matter of course.

Figure 5:
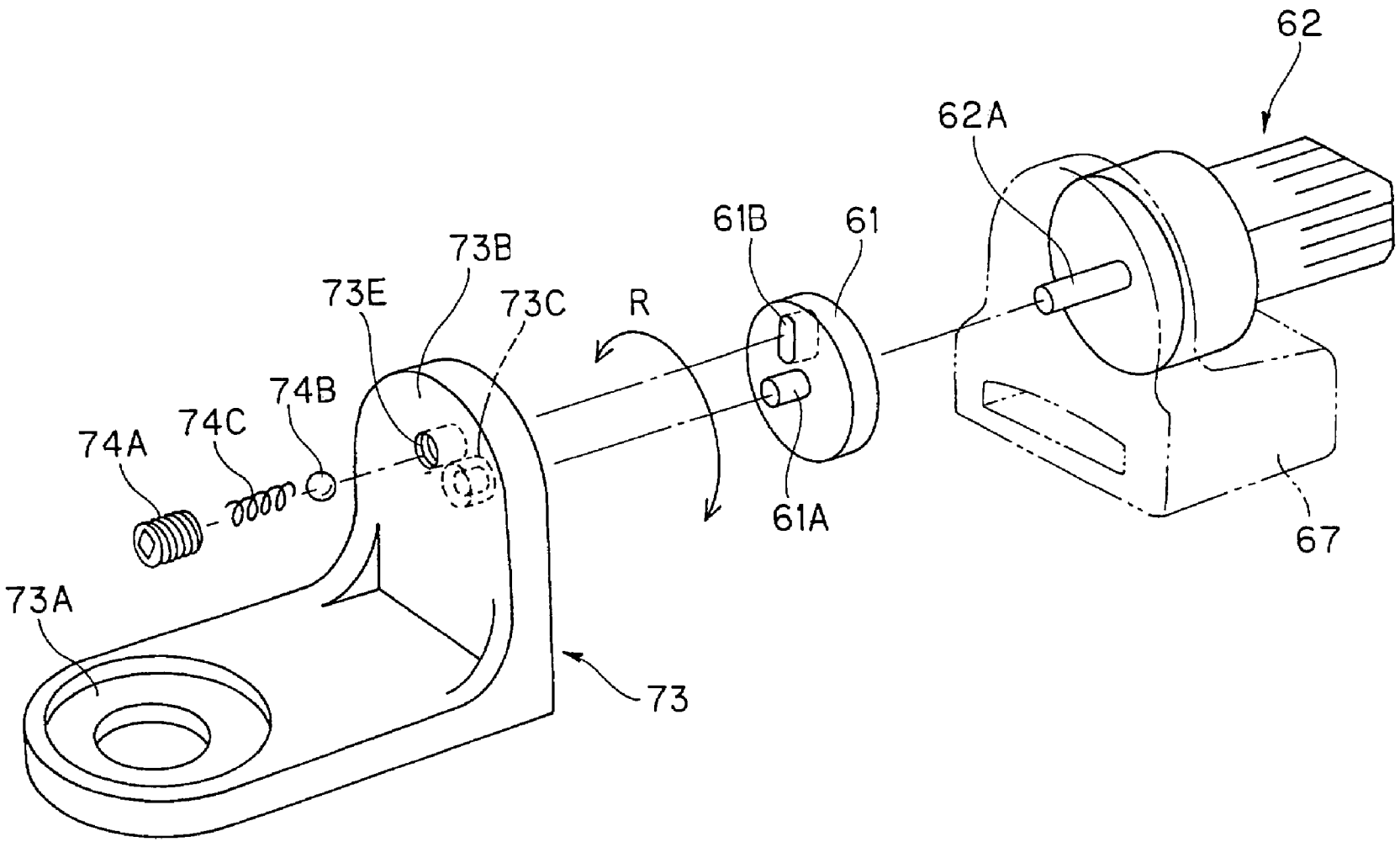
FIG. 5 is an exploded perspective view explaining a mechanical safety switch in the leg twisting direction included in the repositioning apparatus shown in FIG. 1.

FIG. 5 shows the mechanical safety switch provided on a power transmission system from the first drive unit 62 for making the leg K1 perform the twisting action (in the direction indicated by the arrow R).

In FIG. 5, the first movable table 61 for moving the lower leg supporting bed 58 (See FIG. 1 and FIG. 3) about the horizontal axis (60) is formed into a disc shape, and is fixed to an output shaft 62A of the motor 62, which is the first drive unit for driving the first movable table 61. A cylindrical projection 61A is formed at the axis of rotation of the first movable table 61 on the opposite side from the motor 62, and the projection 61A is rotatably fitted into a bearing portion 73C, which is provided on the link-up plat 73. Accordingly, the link-up plate 73 can rotate with respect to the first movable table 61.

The first movable table 61 is formed with a through hole 61B, which is shaped like a radially elongated oval in cross section, at the position deviated form the center of rotation. On the other hand, the link-up plate 73 is formed with a through screw hole 73E at the position corresponding to the through hole 61B. An adjusting screw 74A is screwed into the screw hole 73E. A steel ball 74B is disposed at the distal end of the threaded portion of the adjusting screw 74A, and the steel ball 74B is movably inserted into the screw hole 73E. A coil spring 74C is interposed between the adjusting screw 74A and the steel ball 74B in a contracted state, whereby the steel ball 74B is urged and pressed against the through hole 61B with a predetermined pressing force. The width of the through hole 61B is set to a value smaller than the diameter of the steel ball 74B, and thus the steel ball 74B will never enter into the through hole 61B.

In this arrangement, when making the leg K1 perform the twisting action (in the direction indicated by the arrow R), a driving force from the motor 62 is transmitted to the lower leg supporting bed 58 via the first movable table 61, the steel ball 74B, the link-up plate 73, . . . in sequence. When an unreasonable force in the twisting direction is about to be exerted to the leg K1, the steel ball 74B is released from engagement with the through hole 61B against an urging force from the coil spring 74C, and thus no power is transmitted. The "unreasonable force" is adjusted in advance by the amount of tightening of the adjusting screw 74A.

Subsequently, the mechanical safety switch provided on a power transmission system from the second drive unit 68 (See FIG. 4) for making the leg K1 perform the bending and stretching action (in the direction indicated by the arrow Y) will be described referring to FIG. 6.

Figure 6:
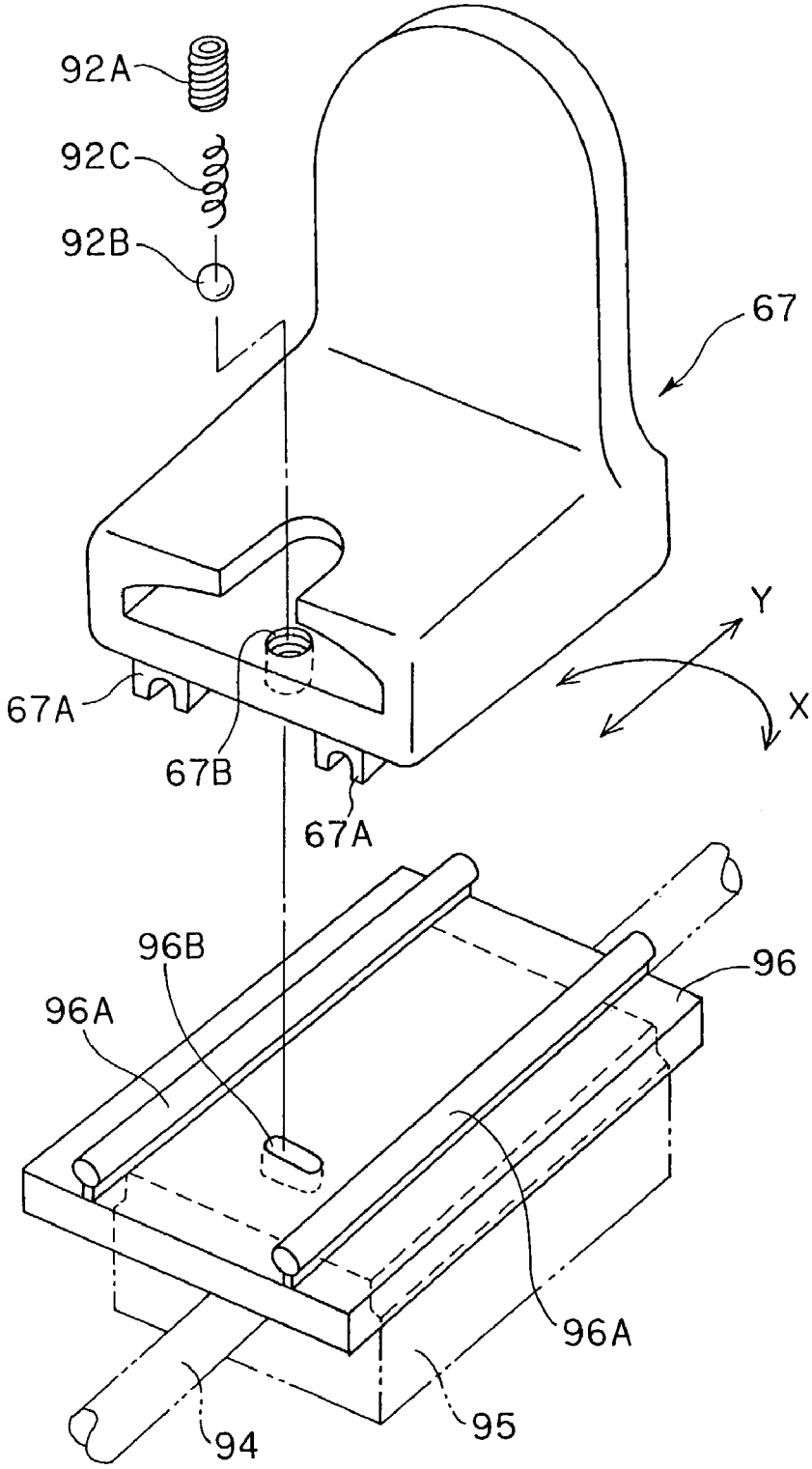
FIG. 6 is an exploded perspective view for explaining a mechanical safety switch in the direction of stretching and bending the leg included in the repositioning apparatus shown in FIG. 1.

As shown in FIG. 6, an intermediate plate 96 is interposed between the second movable table 67 and the inner block 95 provided on the second drive unit 68 for moving the lower leg supporting bed 58 (See FIG. 1 and FIG. 3) in the substantially horizontal direction, and the intermediate plate 96 is fixed on the upper surface of the inner block 95.

For example, two guiding shafts 96A are arranged and fixed in parallel in the direction of movement of the inner block 95 on the upper side of the intermediate plate 96. A movable block 67A is secured on the lower surface of the second movable table 67, and the movable block 67A movably engages the guiding shaft 96A. Accordingly, the second movable table 67 is capable of reciprocating in the direction of movement of the inner block 95 with respect to the inner block 95 and the intermediate plate 96.

The intermediate plate 96 is formed with a through hole 96B, which is laterally (in the direction indicated by the arrow X) elongated oval shape in cross section. On the other hand, the second movable table 67 is formed with a through screw hole 67B at the position corresponding to the through hole 96B, and an adjusting screw 92A is screwed into the screw hole 67B. A steel ball 92B is disposed at the distal end of the threaded portion of the adjusting screw 92A, and the steel ball 92B is movably fitted into the screw hole 67B. A coil spring 92C is interposed between the adjusting screw 92A and the steel ball 92B in a contracted state, whereby the steel ball 92B is urged and pressed against the through hole 96B with a predetermined pressing force. The width of the through hole 96B is set to a value smaller than the diameter of the steel ball 92B, and thus the steel ball 92B will never enter into the through hole 96B.

In this arrangement, when making the leg K1 perform the bending and stretching action (in the direction indicated by the arrow Y), a driving force from the motor 97 (see FIG. 4) is transmitted to the lower leg supporting bed 58 via the inner block 95, the intermediate plate 96, the steel ball 92B, the second movable table 67, . . . in sequence. When an unreasonable force in the stretching or contracting direction is about to be exerted to the leg K1, the steel ball 92B is released from engagement with the through hole 96B against a urging force from the coil spring 92C, and thus no power is transmitted. The "unreasonable force" is adjusted in advance by the amount of tightening of the adjusting screw 92A.

A control system for controlling the repositioning apparatus 5 will be described referring to FIG. 7.

As shown in the figure, the control system includes a control unit 113 for controlling the entire system, sensor 114 for detecting a force exerted on the leg K1 when making the leg K1 perform various actions, a force display 115 for indicating a force detected by the sensors 114, and a portable operation box 117.

The control unit 113 is connected to a motor 120 included in the arm drive unit (the motor 120 is only shown in FIG. 7), and the motors 62, 97, 83, 102, and 104 included in the first and fifth drive unit via the drivers 118, 118 . . . .

Subsequently, the operation of the repositioning apparatus 5 in the construction described above will be described. As shown in FIG. 1, when giving repositioning therapy to the leg 1 of the patient K, the patient K is laid with the lower body placed on the hip rest 50B of the supporting bed 50 and the upper body supported by a table (not shown) as needed. The lower leg K2 and the foot K3 of the patient K is placed on the lower leg supporting bed 58, and the lower leg K2 is fixed by a band 111.

Subsequently, the operation box 117 is operated as needed according to repositioning therapy to be performed, and the swinging arm 52, the first to third movable tables 61, 67 and 64, or the joint members 72A and 72B of the universal joint 72 are driven. In other words, as shown in FIG. 2, in order to move the leg K1 in the lateral direction (arrow X), the swinging arm 52 is moved in the direction indicated by the arrow X.

In order to make the leg K1 perform the twisting action (in the direction indicated by the arrow R), the first movable table 61 is rotated. In order to move the leg K1 in the vertical (arrow Z) direction, the third movable table 64 is driven in the vertical direction. In order to make the leg K1 perform the bending and stretching action in the fore-and-aft direction (arrow Y), the second movable table 67 is moved in the fore-and-aft direction.

Further, in order to swing the ankle K4 in the lateral direction (in the direction indicated by the arrow P), the second joint member 72B on the lower side of the universal joint 72 is rotated in the same direction. In order to bend the ankle K4 in the fore-and-aft direction (in the direction indicated by the arrow Q), the joint member 72A on the upper side of the universal joint 72 is rotated in the same direction.

In the description given thus far, the respective motors are actuated when the doctor operates the operating box 117, and thus the swinging arm 52 and other members are driven to move the leg K1 of the patient K in the suitable directions. On the other hand, however, such an operation that the doctor moves the leg K1 by his own power to a position, which is the best position for giving repositioning therapy, and makes the apparatus recognize that best position is also performed. In such a case, when an attempt is made to move the leg K1 of the patient K by the doctor, a maintaining force, which is exerted by the driving system including the respective motors, blocks the power to move the leg K1.

Accordingly, the following construction is employed.

The sensors 114 described above can detect external forces (forces exerted by the doctor and the like) in any directions along the six axes (indicated by the arrows X, Y, Z, P, Q and R). The sensors 114 are, as shown in FIG. 1 and FIG. 3, interposed between a seat member 72A1 formed at the joint member 72A included in the universal joint 72 and a seat member 110A formed on the back side of a sole pad member 110 on the lower leg supporting bed 58.

In the operation box 117 shown in FIG. 7, there is provided a switch for switching the control of the repositioning apparatus between the case of moving the leg K1 to a desired position by the operation of the motors and the case of moving the leg K1 to the best position for the doctor to give repositioning therapy by his/her own power. The control unit 113 changes the control depending on the switching operation. When moving the leg K1 to a desired position by the operation of the motors, the control is made in a manner described above, and when the switch is changed to move the leg K1 to the best position for the doctor to give repositioning therapy by his/her own power, the control is made as described below.

When an attempt is made by the doctor to move the leg K1 to a desired direction, a force in that direction is exerted on the sensors 114, and the sensors 114 detect the strength and the direction of the force. Then, the control unit 113 drives the motor corresponding to that direction in the direction to reduce the power to be exerted by the doctor. The motor is stopped when the force detected by the sensors 114 reached zero. Accordingly, the leg K1 is moved as much as the doctor intended, and when the doctor stopped exerting a force, the leg K1 is maintained as it is by the maintaining force of the driving system (motor and the like).

The inventor refers the above-described operation, that is, the operation to move the leg K1 to the best position for giving repositioning therapy by the doctor's own power, and then make the apparatus recognize the position to as direct teaching.

As described above, the repositioning apparatus 5 includes the supporting bed 50 for supporting at least the lower body of the patient K to be given repositioning therapy on his/her leg K1, the lower leg supporting bed 58 for supporting the lower leg K2 of the patient K, the first movable table 61 for moving the lower leg supporting bed 58 about the substantially horizontal axis 60, the first drive unit 62 for driving the first movable table 61, the second movable table 67 for moving the lower leg supporting bed 58 in the substantially horizontal direction, the second drive unit 68 for driving the second movable table 67, the swinging arm 52 for swinging the lower leg supporting bed in the substantially horizontal plane, the third movable table 64 for moving the lower leg supporting bed 58 in the substantially vertical direction, and the third drive unit 65 for driving the third movable table 64. Therefore, the apparatus can make the leg K1 perform the twisting action, the bending and stretching action, the laterally moving action, and the vertically moving action, that is, a single apparatus can make the leg K1 perform almost all actions required for repositioning therapy.

In addition, by the provision of the arm drive unit 120 for driving the swinging arm 52, the swinging movement of the swinging arm 52 can be made automatically, without depending on the human power.

By making the swinging arm 52 telescopic, the swinging arm 52 can telescopically be adjusted as needed to accommodate any physical constitutions of the patient K, such as small, large, adult, or child.

By the provision of the arm expansion device for telescopically adjusting the swinging arm 52, the adjustment of the swinging arm 52 can be performed automatically, and almost no human power is necessary.

In addition, the swinging arm 52 makes the leg K1 perform the laterally moving action, the first movable table 61 makes the leg K1 perform the twisting action, the second movable table 67 makes the leg K1 perform the bending and stretching action, and the third movable table 64 makes the leg K1 perform the vertically moving action. This construction is suitable for allowing the doctor or the like to perform repositioning therapy as desired.

The swinging arm 52, the first movable table 61, the second movable table 67, the third movable table 64, and the lower leg supporting table 58 can be assembled in stages in a predetermined sequence, for example, in sequence as stated in the present embodiment. In this arrangement, the construction can be simplified in comparison with the case in which the respective components are assembled independently and separately.

Since the lower leg supporting bed 58 is provided with the fixing device (band 111 and the like) for fixing the lower leg K2 of the patient K, a force can effectively be transmitted from the lower leg supporting bed 58 to the leg of the patient K.

Since the joint members 72A and 72B are provided so that the lower leg supporting bed 58 can move about the substantially horizontal axis or the substantially vertical axis, the apparatus can make the ankle K4 bend in the fore-and-aft direction and swing in the lateral direction.

Although it is possible to make the leg K1 and the ankle K4 perform various actions separately and independently, it is also possible to make them perform at least two actions simultaneously. For example, by driving the swinging arm 52 and the joint members 72A and 72B simultaneously, the apparatus can make the leg K1 perform the laterally moving action while making the ankle K4 perform the bending movement in the fore-and-aft direction.

In addition, since the lower leg supporting bed 58 is provided with an auxiliary member (auxiliary table 106), which is capable of expanding and contracting longitudinally of the lower leg K2 and freely attached and detached, in the normal state, the burden of the patient K can be alleviated by attaching the auxiliary member to the lower leg supporting bed 58 and supporting the entire lower leg K2 in the expanded state. In addition, when having an X-ray taken, the auxiliary member can be contracted or removed to prevent the auxiliary member from being X-rayed.

Since the lower leg supporting bed 58 is provided with the sole pad member 110 for placing the sole of the patient K, when making the leg K1 perform bending and stretching action in the fore-and-aft direction, or when making the ankle K4 perform the bending action in the fore-and-aft direction or laterally moving action, a force is applied to the entire region of the sole of the patient K, whereby the patient K is prevented from being applied with needless pain.

Although the drive unit (arm drive unit) for swinging the swinging arm 52 of the repositioning apparatus 5 is provided in the embodiment described above, the drive unit is not always necessary. If it is not provided, the swinging arm 52 is swung and fixed to a desired position by a human power.

As is described thus far, the repositioning apparatus according to the invention includes a supporting bed for supporting at least the lower body of a patient, who needs repositioning therapy on his/her leg, a lower leg supporting bed for supporting the lower leg of the patient, a first movable table for allowing the lower leg supporting bed about a substantially horizontal axis, the first drive unit for driving the first movable table, a second movable table for moving the lower leg supporting bed in the substantially horizontal direction, and the second drive unit for driving the second movable table.

In this arrangement, since the repositioning apparatus can make the lower leg of the patient perform the twisting action and the bending and stretching action, which are inevitable action for repositioning the patient's lower leg, the burden of the doctor or the practitioner, who gives repositioning therapy, can be alleviated, time required for repositioning therapy may be significantly shortened, and the number of staffs can be reduced, thereby enabling the doctor or the practitioner to give repositioning therapy to a number of patients a day.

In addition, the repositioning apparatus according to the invention includes the swinging arm for swinging the lower leg supporting bed in a substantially horizontal plane, the third movable table for moving the lower leg supporting bed in the substantially vertical direction, and the third drive unit for driving the third movable table. Therefore, the apparatus can make the patient's lower leg perform not only the twisting action and the bending and stretching action, but also the laterally moving action and the vertically moving action, there positioning apparatus can make the patient's lower leg perform almost all the actions that is required for repositioning the lower leg.

In addition, by the provision of the arm drive unit for driving the swinging arm, the swinging motion of the swinging arm may be generated automatically without depending on the human power.

Since the swinging arm is telescopic, the repositioning apparatus of the invention can cope with patients of any physical constitutions, such as small, large, adult, child, and so on, by telescopically adjusting the swinging arm.

Since the arm expansion device for telescopically adjusting the swinging arm is provided, the swinging arm can telescopically be adjusted automatically, and thus almost no human power is necessary.

The swinging arm can make the leg perform the laterally moving action, the first movable table can make the leg perform the twisting action, the second movable table can make the leg perform the bending and stretching action, and the third movable table can make the leg perform the vertically moving action. This arrangement is suitable for the doctor to perform repositioning therapy as desired.

The swinging arm, the first movable table, the second movable table, the third movable table and the lower leg supporting bed can be assembled to the supporting bed in predetermined sequence in stages, for example, as described above In this arrangement, the construction can be simplified in comparison with the case in which the each part, such as the swinging arm, is independently and separately attached.

Since the lower supporting bed may include the fixing device for fixing the lower leg of the patient K, a force is effectively transmitted from the lower leg supporting bed to the leg of the patient.

Since the joint member is provided for making the lower leg supporting bed movable about the substantially horizontal axis, or about the substantially vertical axis, there positioning apparatus can make the ankle perform the bending movement in the fore-and-aft direction and the laterally moving action.

Although it is possible to make the leg and the ankle perform various actions separately and independently, it is also possible to make them perform at least two actions simultaneously. For example, by driving the swinging arm and the joint members simultaneously, the apparatus can make the leg perform the laterally moving action while making the ankle perform the bending movement in the fore-and-aft direction.

In addition, since the lower leg supporting bed is provided with the auxiliary member, which is capable of expanding and contracting longitudinally of the lower leg and freely attached and detached, in the normal state, the burden of the patient can be alleviated by attaching the auxiliary member to the lower leg supporting bed and supporting the entire lower leg in the expanded state. In addition, when having an X-ray taken, the auxiliary member can be contracted or removed to prevent the auxiliary member from being X-rayed.

Since the lower leg supporting bed is provided with the sole pad member for placing the sole of the patient, when making the leg perform bending and stretching action in the fore-and-aft direction, or when making the ankle perform the bending action in the fore-and-aft direction or laterally moving action, a force is applied to the entire region of the sole of the patient, whereby the patient is prevented from being applied with needless pain.

What is claimed is:

1. A repositioning apparatus comprising:

a supporting bed for supporting at least a lower body of a patient, who will be given repositioning therapy;

a lower leg supporting bed for supporting a lower leg of the patient;

a first movable table located underneath a bottom of a foot for allowing the lower leg supporting bed about a substantially horizontal axis and a first drive unit for driving the first movable table;

a second movable table for moving the lower leg supporting bed in the substantially horizontal direction and a second drive unit for driving the second movable table;

a first joint member, which can move freely about the substantially horizontal axis, and a third drive unit for moving the first joint member about the substantially horizontal axis are interposed between the lower leg supporting bed and the first movable table;

a second joint member that constitutes a universal joint with the first joint member and is able to move freely about the substantially vertical axis; and a fourth drive unit for moving the second joint member about the substantially vertical axis interposed between the lower leg supporting bed and the first movable table.

* * * * *